US009673532B2

(12) United States Patent
Cheng et al.

(10) Patent No.: US 9,673,532 B2
(45) Date of Patent: Jun. 6, 2017

(54) ANTENNA

(71) Applicant: Huawei Technologies Co., Ltd., Shenzhen, Guangdong (CN)

(72) Inventors: Yujian Cheng, Chengdu (CN); Yi Chen, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 7 days.

(21) Appl. No.: 15/010,281

(22) Filed: Jan. 29, 2016

(65) Prior Publication Data

US 2016/0149311 A1 May 26, 2016

Related U.S. Application Data

(63) Continuation of application No. PCT/CN2013/080544, filed on Jul. 31, 2013.

(51) Int. Cl.

| | |
|---|---|
| ***H01Q 13/06*** | (2006.01) |
| ***H01P 5/02*** | (2006.01) |
| ***H01Q 1/38*** | (2006.01) |
| *H01P 1/02* | (2006.01) |

(52) U.S. Cl.

CPC ..... *H01Q 13/06* (2013.01); *H01P 5/024* (2013.01); *H01Q 1/38* (2013.01); *H01P 1/025* (2013.01); *H01P 1/027* (2013.01)

(58) Field of Classification Search

CPC ..... H01Q 13/06; H01Q 1/38; H01P 5/024

See application file for complete search history.

(56) References Cited

U.S. PATENT DOCUMENTS

| | | | | |
|---|---|---|---|---|
| 6,359,590 | B2 * | 3/2002 | Takenoshita | H01P 3/121 343/700 MS |
| 8,866,562 | B2 * | 10/2014 | Shimura | H01P 5/024 333/21 R |
| 2008/0238579 | A1 | 10/2008 | Okano | |
| 2009/0213013 | A1 | 8/2009 | Lindmark et al. | |
| 2011/0248884 | A1 | 10/2011 | Yano et al. | |
| 2011/0248891 | A1 | 10/2011 | Han et al. | |
| 2012/0050124 | A1 | 3/2012 | Tu | |

FOREIGN PATENT DOCUMENTS

| | | | |
|---|---|---|---|
| CN | 101179155 | A | 5/2008 |
| CN | 101483278 | A | 7/2009 |
| CN | 102255136 | A | 11/2011 |

(Continued)

OTHER PUBLICATIONS

Basset Youzkatli El Khatib et al., "Substrate-Integrated Waveguide Vertical Interconnects for 3-D Integrated Circuits", IEEE Transactions on Components, Packaging and Manufacturing Technology, vol. 2, No. 9, Sep. 2012, p. 1526-1535.

(Continued)

*Primary Examiner* — Hoang Nguyen

(57) ABSTRACT

The present invention relates to an antenna, which includes a feeding part and a radiating part. By using the feeding part and the radiating part that are perpendicular to each other and use dielectric substrates, not only a volume of a normal radiation antenna is reduced, but also a substrate integrated waveguide directly radiates energy outwards, thereby improving operating bandwidth of the antenna.

10 Claims, 3 Drawing Sheets

(56) References Cited

FOREIGN PATENT DOCUMENTS

| | | | |
|---|---|---|---|
| CN | 102377019 | A | 3/2012 |
| CN | 103066360 | A | 4/2013 |
| CN | 103178341 | A | 6/2013 |

OTHER PUBLICATIONS

Bassel Youzkatli El Khatib et al., "Three-Dimensional Architecture of Substrate Integrated Waveguide Feeder for Fermi Tapered Slot Antenna Array Applications", IEEE Transactions on Antennas and Propagation, vol. 60, No. 10, Oct. 2012, p. 4610-4618.
Wael M. Abdel-Wahab et al., "Low Cost 60 GHz Millimeter-Wave Microstrip Patch Antenna Array Using Low-Loss Planar Feeding Scheme", IEEE, 2011, p. 508-511.
Ali Doghri et al., "Compact and Low Cost Substrate Integrated Waveguide Cavity and Bandpass Filter Using Surface Mount Shorting Stubs", IEEE, 2012, 3 pages.
All Doghri et al., "SIW 90-Degree Twist for Substrate Integrated Circuits and Systems", IEEE, 2013, 3 pages.

* cited by examiner

ANTENNA

CROSS-REFERENCE TO RELATED APPLICATIONS

This application is a continuation of International Application No. PCT/CN2013/080544, filed on Jul. 31, 2013, which is hereby incorporated by reference in its entirety.

TECHNICAL FIELD

The present invention relates to wireless communications technologies, and in particular, to an antenna.

BACKGROUND

With the development of wireless communications technologies, use of a substrate integrated waveguide appears to implement a millimeter wave antenna. The substrate integrated waveguide is a new type of a planar transmission line, and not only has good performance similar to performance of a metallic waveguide, and but also has a structural feature similar to a structural feature of a traditional planar transmission line. Therefore, the substrate integrated waveguide is quite suitable for design of a millimeter wave antenna.

A millimeter wave antenna includes an end-fire antenna and a normal radiation antenna. Compared with the end-fire antenna, the normal radiation antenna has an apparent advantage in terms of arraying, assembling, and the like, and therefore is more widely applied.

An existing normal radiation antenna is obtained by superposing twelve layers of metal plates. A bottommost layer is one complete metal plate, and an upper layer of the bottommost layer is five superposed metal plates. The five superposed metal plates have a same shape, and are provided with U-shape openings, where space formed by the U-shape openings after superposition is a feeding waveguide. An upper layer of the five superposed metal plates is a metal plate that is provided with a through hole in the middle of the metal plate, where the through hole is a coupling gap used to change a direction of a signal transmitted by the feeding waveguide. An upper layer of the metal plate that is provided with a through hole in the middle of the metal plate is four superposed metal plates. Shapes of the four superposed metal plates are the same, and through holes are disposed inside the four superposed metal plates. These through holes are superposed together to form a cavity for signal transmission. An uppermost layer is one metal plate that is provided with four through holes, where the four through holes are radiation gaps and used for transmit a radio signal.

However, the normal radiation antenna is formed by superposing twelve layers of metal plates, causing a relatively large volume, and a relatively high material cost and processing process cost.

Another existing normal radiation antenna is based on a substrate integrated waveguide technology, where processing is convenient, and a cost is low. However, because a radiating element uses a gap structure, that is, a radiation gap, to send a signal, where the radiation gap is essentially a resonate structure, and a response of the radiation gap is strongly correlated with a frequency. When a signal frequency deviates from a center frequency, radiation efficiency of the antenna remarkably decreases, causing that bandwidth of the antenna is relatively narrow.

SUMMARY

In view of this, embodiments of the present invention provide an antenna, so as to reduce a volume of a normal radiation antenna, and improve bandwidth of the normal radiation antenna.

According to a first aspect, an embodiment of the present invention provides an antenna, including:

a feeding part, including a first dielectric substrate, where a surface of the first dielectric substrate is covered with a metal layer, and an end of the first dielectric substrate is an input port of the feeding part; multiple parallel plated-through holes are disposed on the first dielectric substrate, where an arrangement direction of the plated-through holes is perpendicular to an end face of the first dielectric substrate, and the multiple parallel plated-through holes are arranged along sides, except a side at which the input port is located, of the first dielectric substrate; and a coupling groove is disposed in a part that is of the first dielectric substrate and that is close to an end opposite to the input port, a bottom of the coupling groove is the surface of the first dielectric substrate, a groove wall is a section of the metal layer, and the coupling groove is located inside space formed by an arrangement of the plated-through holes; and a radiating part, including a second dielectric substrate, where a surface of the second dielectric substrate is covered with a metal layer, and an end of the second dielectric substrate is a radiation port; a row of parallel plated-through holes is disposed on either side that is of the second dielectric substrate and that is adjacent to the radiation port, where an arrangement direction of the plated-through holes is perpendicular to an end face of the second dielectric substrate; and an end, opposite to the radiation port, of the second dielectric substrate is connected to the part, at which the coupling groove is disposed, of the first dielectric substrate, and covers the coupling groove.

With reference to the first aspect, in a first possible implementation manner of the first aspect, a distance, on a direction of a long side of the coupling groove, between a centerline of long sides of the coupling groove and plated-through holes arranged at a side opposite to the side at which the input port is located is a quarter of a dielectric waveguide wavelength of a central frequency of the antenna.

With reference to the first aspect or the first possible implementation manner of the first aspect, in a second possible implementation manner of the first aspect, a centerline of short sides of the coupling groove is superposed with a thickness centerline of the second dielectric substrate.

With reference to the first aspect or the first or the second possible implementation manner of the first aspect, in a third possible implementation manner of the first aspect, a length of a short side of the second dielectric substrate is greater than one half of an operating wavelength of the antenna.

With reference to the first aspect or any one of the first to the third possible implementation manners of the first aspect, in a fourth possible implementation manner of the first aspect, an electric field mode of the coupling groove is the same as a dominant mode in the radiating part.

According to the antenna provided in the foregoing embodiment, by using a feeding part and a radiating part that are perpendicular to each other and use dielectric substrates, not only a volume of a normal radiation antenna is reduced, but also a substrate integrated waveguide directly radiates energy outwards, thereby improving operating bandwidth of the antenna.

BRIEF DESCRIPTION OF THE DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION

To make the objectives, technical solutions, and advantages of the present invention clearer, the following further describes the present invention in detail with reference to the accompanying drawings. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
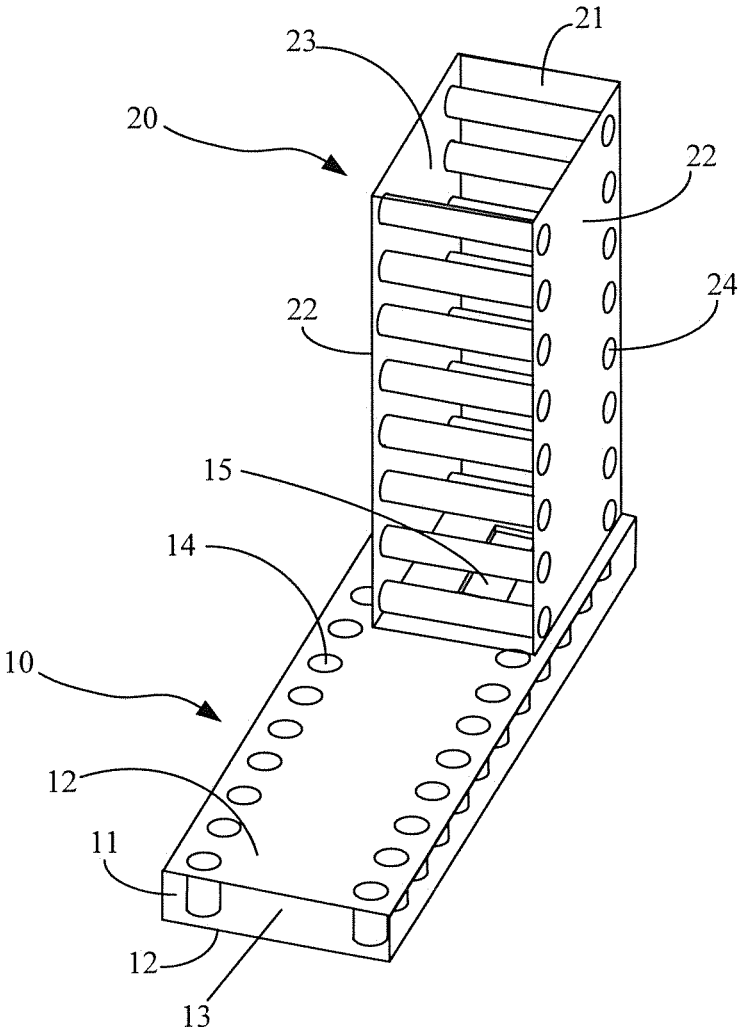
FIG. 1 is a schematic structural diagram of an antenna according to an embodiment of the present invention.

FIG. 1 is a schematic structural diagram of an antenna according to an embodiment of the present invention. In order to show an internal structure of the antenna more clearly, transparency processing is performed on a first dielectric substrate and a second dielectric substrate in FIG. 1. In addition, because metal layers on a surface of the first dielectric substrate and a surface of the second dielectric substrate are relatively thin, thicknesses of the metal layers are not shown in FIG. 1.

In this embodiment, the antenna includes a feeding part 10 and a radiating part 20.

Figure 2:
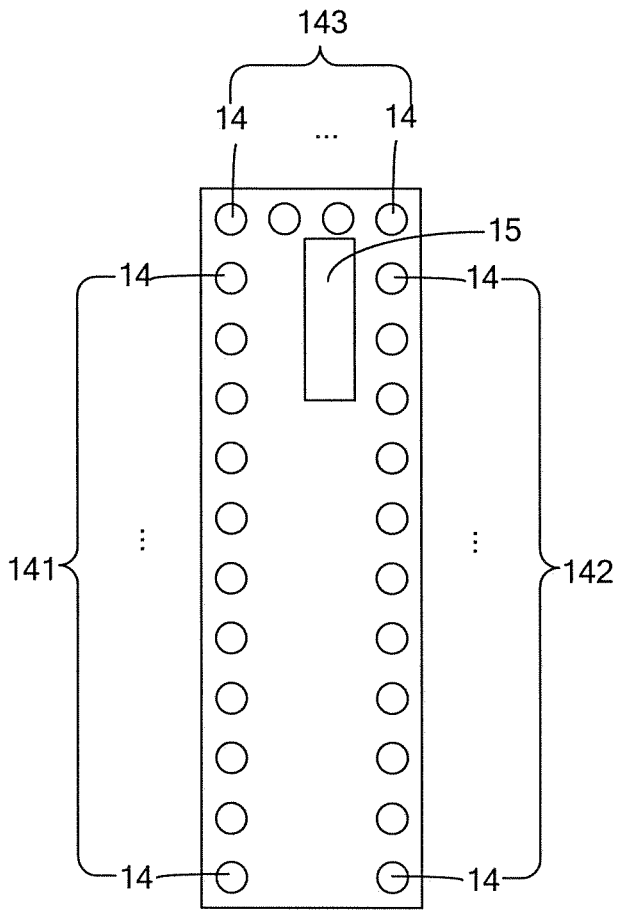
FIG. 2 is a schematic diagram of a feeding part in an antenna according to an embodiment of the present invention.

The feeding part 10 includes a first dielectric substrate 11, where a surface of the first dielectric substrate 11 is covered with a metal layer 12, and an end of the first dielectric substrate 11 is an input port 13 of the feeding part 10. Multiple parallel plated-through holes 14 are disposed on the first dielectric substrate 11, where as shown in FIG. 2, an arrangement direction of the plated-through holes 14 is perpendicular to an end face of the first dielectric substrate 11, and the multiple parallel plated-through holes are arranged along sides, except a side at which the input port 13 is located, of the first dielectric substrate 11. A coupling groove 15 is disposed in a part that is of the first dielectric substrate 11 and that is close to an end opposite to the input port 13, a bottom of the coupling groove 15 is the surface of the first dielectric substrate 11, and a groove wall is a section of the metal layer 12, that is, the coupling groove 15 is formed by removing a part of the metal layer 12 from the first dielectric substrate 11. The coupling groove 15 is located inside space formed by an arrangement of the plated-through holes 14.

The metal layer 12 may be a copper layer. Both ends of the plated-through holes 14 are separately connected to metal layers on both an upper surface and a lower surface of the first dielectric substrate 11. Two rows of plated-through holes (for ease of description, one row of plated-through holes is referred to as a first row of plated-through holes 141, and the other row of plated-through holes is referred to as a second row of plated-through holes 142) that are disposed at two sides, adjacent to the input port 13, of the first dielectric substrate 11 are parallel to each other, and form a feeding substrate integrated waveguide together with the metal layers on both the upper surface and the lower surface of the first dielectric substrate 11. A row of plated-through holes (for ease of description, the row of plated-through holes is referred to as a third row of plated-through holes 143) that is disposed at a side, opposite to the input port 13, of the first dielectric substrate 11 forms a short-circuit end of the feeding substrate integrated waveguide together with the metal layers on both the upper surface and the lower surface of the first dielectric substrate 11. That is, because the third row of plated-through holes 143 is disposed at the side, opposite to the input port 13, of the first dielectric substrate 11, the end, opposite to the input port 13, of the first dielectric substrate 11 is short circuited. Therefore, after entering from the input port 13, an electromagnetic wave is transmitted in the first dielectric substrate 11 and stops being transmitted when reaching the third row of plated-through holes 143 instead of continuing to be transmitted forward to the end opposite to the input port 13, and is transmitted by using the coupling groove 15.

The coupling groove 15 is a rectangle and is in a part that is on the metal layer of the first dielectric substrate 11 and that is close to the short-circuit end. A short side of the coupling groove 15 is parallel to the third row of plated-through holes 143, and a centerline of short sides deviates from a centerline of short sides of the feeding substrate integrated waveguide.

Figure 3:
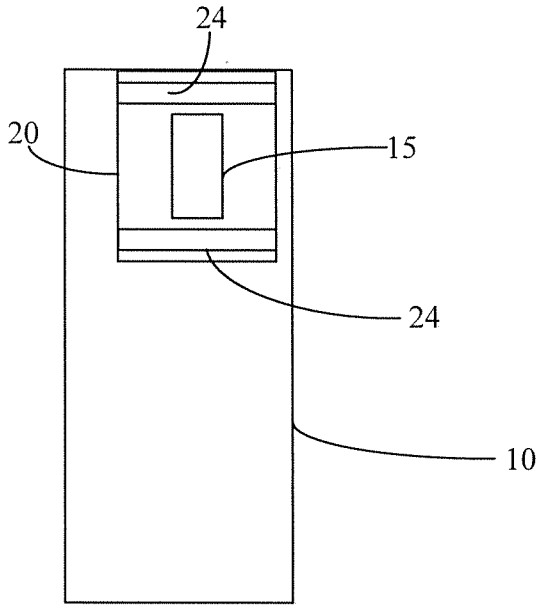
FIG. 3 is a schematic diagram of an end face of a coupling groove covered by a radiating part in an antenna according to an embodiment of the present invention.

The radiating part 20 is a radiating substrate integrated waveguide, and may specifically include a second dielectric substrate 21, where a surface of the second dielectric substrate 21 is covered with a metal layer 22, and an end of the second dielectric substrate 21 is a radiation port 23 used for radiating an electromagnetic wave to space. A row of parallel plated-through holes 24 (for ease of description, one row of plated-through holes is referred to as a fourth row of plated-through holes, and the other row of plated-through holes is referred to as a fifth row of plated-through holes) is disposed on either side that is of the second dielectric substrate 21 and that is adjacent to the radiation port 23, where an arrangement direction of the plated-through holes 24 is perpendicular to an end face of the second dielectric substrate 21. An end, opposite to the radiation port 23, of the second dielectric substrate 21 is connected to the part, at which the coupling groove 15 is disposed, of the first dielectric substrate 11, and as shown in FIG. 3, covers the coupling groove 15. In order to show a structural relationship between the coupling groove and the radiating part 20 more clearly, plated-through holes in the feeding part are omitted in FIG. 3, and transparency processing is performed on the second dielectric substrate.

The metal layer 22 may be a copper layer. Because no plated-through hole is disposed at a side, opposite to the radiation port 23, of the second dielectric substrate 21, the end, opposite to the radiation port 23, of the second dielectric substrate 21 is open circuited, and an electromagnetic wave may be transmitted through the end. Because the end covers the coupling groove 15, the electromagnetic wave transmitted at the feeding part 10 may continue to be transmitted through the coupling groove and the end, and reach the radiating part 20 to be transmitted in the radiating part 20; the electromagnetic wave is transmitted to air through the radiation port 23.

In the radiating part 20, a feeding signal needed by the antenna is propagated in a dielectric waveguide formed by two rows of plated-through holes, namely, the fourth row of plated-through holes and the fifth row of plated-through holes, and the metal layers 22 on two surfaces.

According to the antenna provided in this embodiment, both a feeding part and a radiating part include a dielectric substrate, a metal copper coating layer covered on a surface of the dielectric substrate, and plated-through holes disposed on the dielectric substrate, where one substrate integrated waveguide is horizontally placed and is used as the feeding part, and the other substrate integrated waveguide is vertically placed and is used as the radiating part. One end of the feeding part is an input port, the other end that is short circuited is a short-circuit end, and there is a coupling groove close to the short-circuit end. One end of the radiating part is open circuited and covers the coupling groove, and the other end of the radiating part is also open circuited and radiates energy. In this way, the radiating part not only implements transition from the horizontally placed feeding substrate integrated waveguide to the vertically placed radiating substrate integrated waveguide, and but also radiates energy outwards. Therefore, according to the antenna, by using the feeding part and the radiating part that are perpendicular to each other and use dielectric substrates, not only a volume of a normal radiation antenna is reduced, but also the substrate integrated waveguide directly radiates energy outwards, thereby improving operating bandwidth of the antenna.

Further, a distance, on a direction of a long side of the coupling groove, between a centerline of long sides of the coupling groove and plated-through holes (that is, the third row of plated-through holes 143) arranged at a side opposite to a side at which the input port is located may be a quarter of a dielectric waveguide wavelength of a center frequency of the antenna.

For example, software simulation and testing may be used to enable reflection generated when the electromagnetic wave passes through the coupling groove to be minimal, so as to determine a length of the coupling groove. By using software simulation and testing, the length of the coupling groove is approximate to one half of a wavelength of an operating center frequency of the antenna, and the distance, on the direction of the long side of the coupling groove, between the centerline of the long sides of the coupling groove and a centerline of the third row of plated-through holes 143 is a quarter of the dielectric waveguide wavelength of the center frequency of the antenna.

Figure 4:
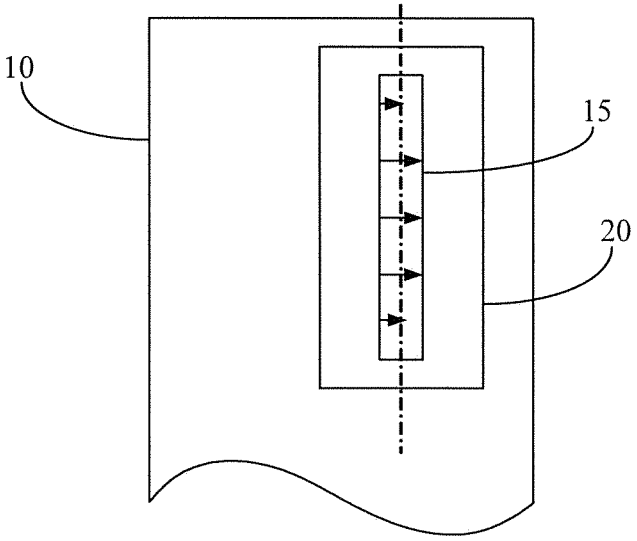
FIG. 4 is a schematic diagram of a position of a coupling groove in an antenna according to an embodiment of the present invention.

Further, as shown in FIG. 4, a centerline of short sides of the coupling groove is superposed with a thickness centerline of the second dielectric substrate. In order to show a relative position relationship between the coupling groove and the radiating part 20 more clearly, plated-through holes in the feeding part and the radiating part are omitted in FIG. 4, and transparency processing is performed on the second dielectric substrate.

Further, a length of a short side of the second dielectric substrate is greater than one half of an operating wavelength of the antenna. A length (that is, the length of the short side of the second dielectric substrate) of a cross section of the radiating part may be greater than one half of the operating wavelength of the antenna. Because the length of the coupling groove is one half of the operating wavelength, the coupling groove may be completely covered by the second dielectric substrate provided that an end of the second dielectric substrate in the radiating part is slightly greater than one half of the operating wavelength, and a specific value may be obtained by means of optimization.

According to a structure completed according to the foregoing design principle, a bandwidth feature thereof is derived from a bandwidth feature provided by the radiating part and a bandwidth feature provided by means of vertical transition. As a transmission line, the substrate integrated waveguide directly radiates energy outwards, and operating bandwidth is definitely quite wide. A schematic diagram of a principle of vertical transition bandwidth is shown in FIG. 4.

Further, an electric field mode of the coupling groove is the same as a dominant mode in the radiating part.

The electric field mode of the coupling groove etched on an upper surface of the metal copper coating layer of the feeding part is completely consistent with the dominant mode in the radiating part, so that a wideband may be matched.

The antenna provided in the foregoing embodiment of the present invention is based on a substrate integrated waveguide technology, and a wideband printed antenna applicable to a millimetric wave frequency band is proposed, and meanwhile, in order to facilitate use of a two-dimensional array and system integration, a feeding part and a radiating part of the wideband printed antenna are perpendicular to each other. In addition, a thickness of the feeding part may be different from that of the radiating part, and therefore, different requirements of the feeding part and the radiating part for a substrate thickness may be separately met, which facilitates system integration while high-performance normal radiation is obtained. In addition, by means of vertical transition between the feeding part and the radiating part, the feeding part and the radiating part are separately located on two planes, which facilitates implementation of deployment of a large-scale two-dimensional antenna array. Due to dielectric filling, at a same frequency, a horn-like structure of the antenna provided in the foregoing embodiment of the present invention is smaller than a metallic waveguide, and in this case, a condition for grating lobe suppression can be met. When vertical transition is implemented, the radiating part can radiate energy outwards from an opening end, and features a simple and compact structure. There is a TE10 mode is in an entire structure, and design is quite simple and performance is excellent. In addition, there is no resonate structure in an antenna solution provided in the foregoing embodiment of the present invention, and matching is good, so that bandwidth of the antenna is quite wide, and −10 dB bandwidth can easily reach more than 30%.

Finally, it should be noted that the foregoing embodiments are merely intended for describing the technical solutions of the present invention, but not for limiting the present invention. Although the present invention is described in detail with reference to the foregoing embodiments, a person of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. An antenna, comprising:

a feeding part, comprising, a first dielectric substrate, wherein a surface of the first dielectric substrate is covered with a metal layer, and an end of the first dielectric substrate is an input port of the feeding part, multiple parallel plated-through holes disposed on the first dielectric substrate, wherein an arrangement direction of the plated-through holes is perpendicular to an end face of the first dielectric substrate, and the multiple parallel plated-through holes are arranged along sides, except a side at which the input port is located, of the first dielectric substrate, and a coupling groove disposed in a part that is of the first dielectric substrate and that is close to an end opposite to the input port, a bottom of the coupling groove is the surface of the first dielectric substrate, a groove wall is a section of the metal layer, and the coupling groove is located inside space formed by an arrangement of the plated-through holes; and a radiating part, comprising, a second dielectric substrate, wherein a surface of the second dielectric substrate is covered with a metal layer, and an end of the second dielectric substrate is a radiation port, a row of parallel plated-through holes disposed on either side that is of the second dielectric substrate and that is adjacent to the radiation port, wherein an arrangement direction of the plated-through holes is perpendicular to an end face of the second dielectric substrate, and an end, opposite to the radiation port, of the second dielectric substrate connected to the part, at which the coupling groove is disposed, of the first dielectric substrate, and covers the coupling groove.

2. The antenna according to claim 1, wherein a distance, on a direction of a long side of the coupling groove, between a centerline of long sides of the coupling groove and plated-through holes arranged at a side opposite to the side at which the input port is located is a quarter of a dielectric waveguide wavelength of a center frequency of the antenna.

3. The antenna according to claim 2, wherein a centerline of short sides of the coupling groove is superposed with a thickness centerline of the second dielectric substrate.

4. The antenna according to claim 2, wherein a length of a short side of the second dielectric substrate is greater than one half of an operating wavelength of the antenna.

5. The antenna according to claim 2, wherein an electric field mode of the coupling groove is the same as a dominant mode in the radiating part.

6. The antenna according to claim 1, wherein a centerline of short sides of the coupling groove is superposed with a thickness centerline of the second dielectric substrate.

7. The antenna according to claim 6, wherein a length of a short side of the second dielectric substrate is greater than one half of an operating wavelength of the antenna.

8. The antenna according to claim 6, wherein an electric field mode of the coupling groove is the same as a dominant mode in the radiating part.

9. The antenna according to claim 1, wherein a length of a short side of the second dielectric substrate is greater than one half of an operating wavelength of the antenna.

10. The antenna according to claim 1, wherein an electric field mode of the coupling groove is the same as a dominant mode in the radiating part.

* * * * *